United States Patent [19]

Vitale

[11] Patent Number: 4,915,430

[45] Date of Patent: Apr. 10, 1990

[54] TAMPER RESISTANT LATCH

[75] Inventor: Lawrence Vitale, Philadelphia, Pa.

[73] Assignee: Mobil Service Systems, Inc., Philadelphia, Pa.

[21] Appl. No.: 264,301

[22] Filed: Oct. 28, 1988

[51] Int. Cl.[4] ..... F05C 1/04

[52] U.S. Cl. ..... 292/145; 292/DIG. 65; 292/288; 292/252

[58] Field of Search ..... 292/288, 292, 253, DIG. 65, 292/1, 302, 137, 162, 145, 147, 146, 252; 49/394; 24/702

[56] References Cited

U.S. PATENT DOCUMENTS

| | | | |
|---|---|---|---|
| 793,109 | 6/1905 | Turner et al. | 292/145 |
| 836,463 | 11/1906 | Rapson | 292/57 |
| 1,209,529 | 12/1916 | Wilson | 292/57 |
| 1,941,126 | 12/1933 | Blackman | 312/112 |
| 1,996,414 | 4/1935 | Gantt | 132/79 |
| 2,117,157 | 5/1938 | Florman | 206/38 |
| 2,227,342 | 12/1940 | Gustowski | 312/155 |
| 2,403,065 | 7/1946 | Engert | 292/DIG. 30 |
| 2,519,011 | 8/1950 | Aurandt | 292/73 |
| 2,814,543 | 11/1957 | Siegel | 312/218 |
| 2,879,123 | 3/1959 | Newcomer Jr. et al. | 312/209 |
| 3,023,601 | 3/1962 | Luikart II et al. | 70/297 |
| 3,069,217 | 12/1962 | Kors | 292/145 |
| 3,298,728 | 1/1967 | Dyf | 292/58 |
| 3,620,483 | 11/1971 | Weinberger | 292/288 |
| 3,623,268 | 11/1971 | Zepf | 292/145 |
| 3,637,245 | 1/1972 | Levack | 292/45 |
| 3,734,551 | 5/1973 | Hughes et al. | 292/17 |
| 3,736,779 | 6/1973 | Pratt | 70/276 |
| 3,744,830 | 7/1973 | Levack | 292/29 |
| 3,782,765 | 1/1974 | Wallyn | 292/103 |
| 3,889,992 | 6/1975 | Shelton | 292/252 |
| 3,909,050 | 9/1975 | Vicendese et al. | 292/128 |
| 3,997,204 | 12/1976 | Krempp | 292/288 |
| 3,997,205 | 12/1976 | MacDonald | 292/288 |
| 4,012,065 | 3/1977 | Miller | 292/288 |
| 4,056,275 | 11/1977 | Keeler II | 292/17 |
| 4,191,411 | 3/1980 | Rodgers | 292/87 |
| 4,226,101 | 10/1980 | Lee | 70/78 |
| 4,647,091 | 3/1987 | Roubin | 292/204 |

FOREIGN PATENT DOCUMENTS

| | | | |
|---|---|---|---|
| 677550 | 11/1930 | France | 292/145 |
| 2135726 | 9/1984 | United Kingdom | 292/145 |

*Primary Examiner*—Gary L. Smith
*Assistant Examiner*—Eric K. Nicholson
*Attorney, Agent, or Firm*—Seidel, Gonda, Lavorgna & Monaco

[57] ABSTRACT

A tamper resistant latch comprising a movable member having a latch engaging arm extending therefrom, and a keeper plate capable of releasably receiving the latch arm. The latch may be used to prevent unauthorized entry into enclosures such as cabinets. The invention is best suited for, but by no means limited to, use with cabinets having glass panel doors. When the latch is engaged the glass doors are secured in the closed position.

18 Claims, 4 Drawing Sheets

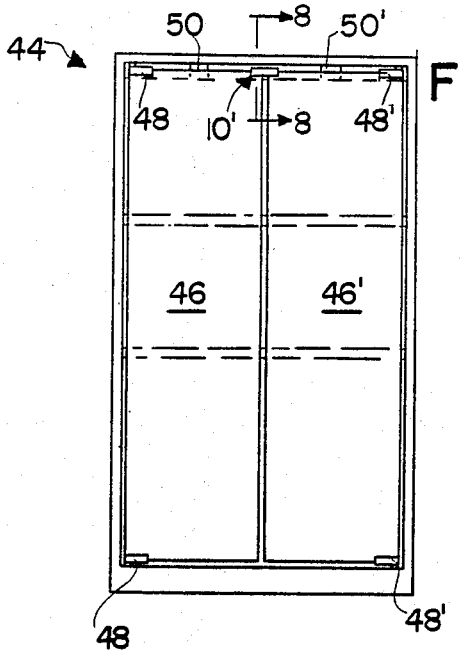
FIG.7
FIG.8
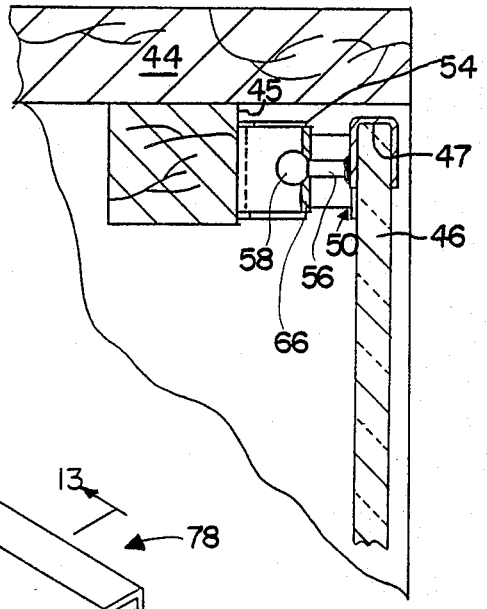
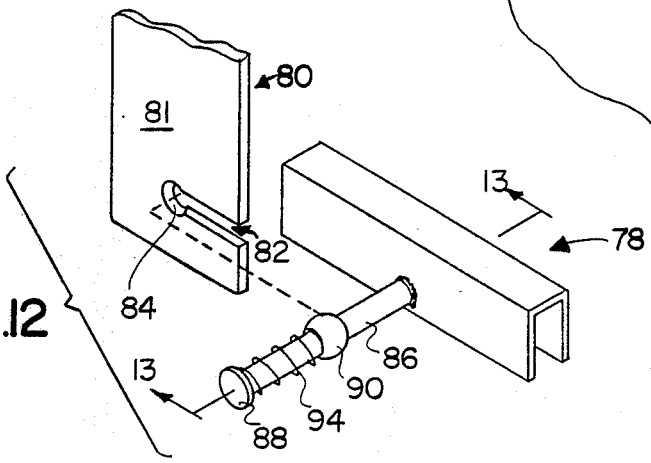
FIG.12
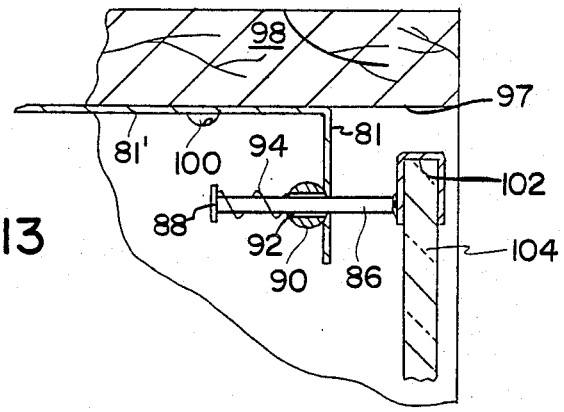
FIG.13

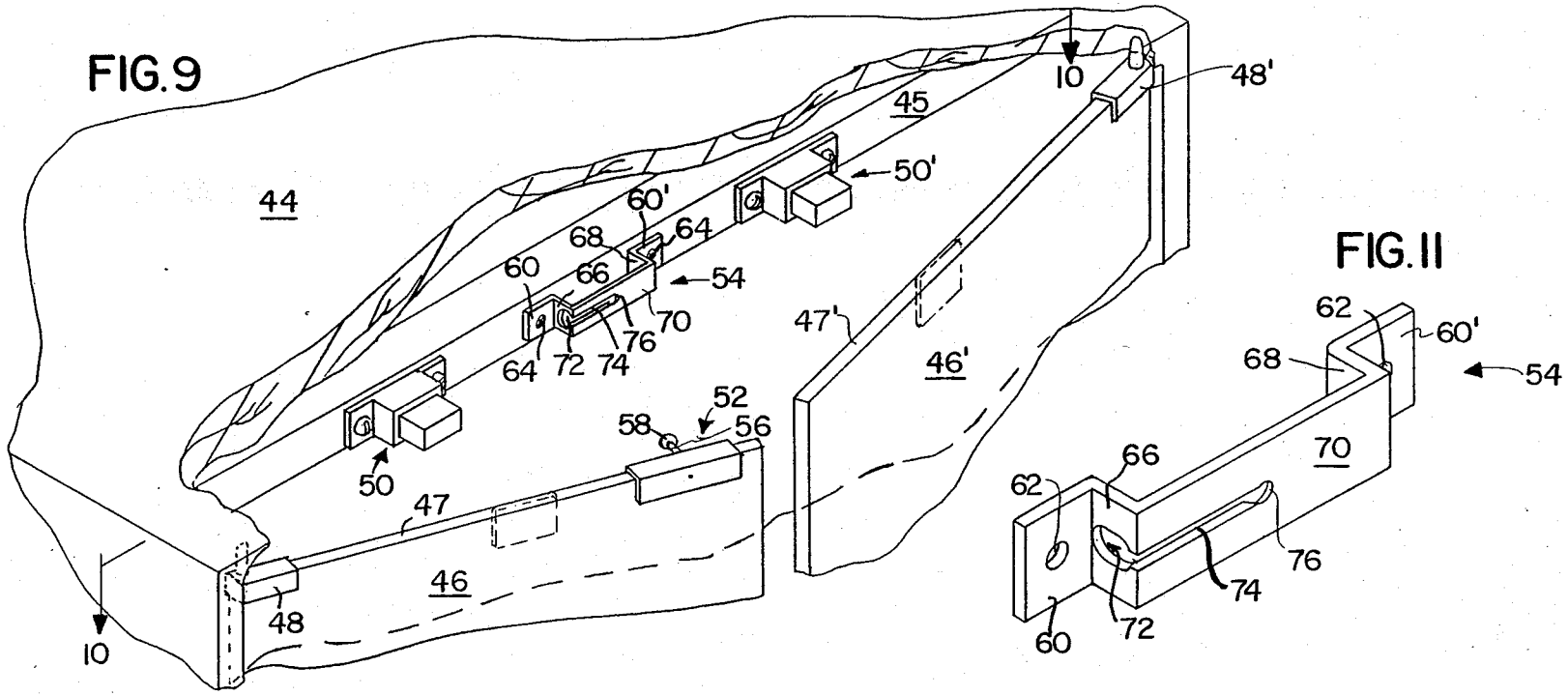
FIG.9
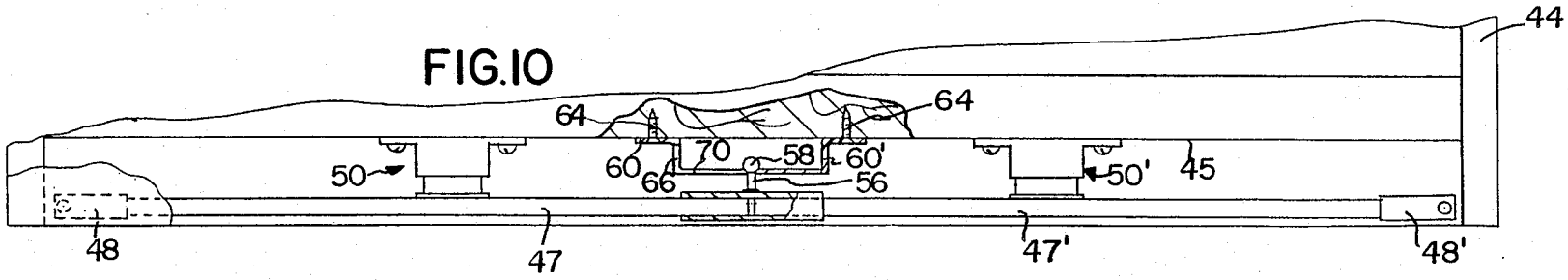
FIG.10
FIG.11

TAMPER RESISTANT LATCH

FIELD OF THE INVENTION

The present invention is directed to latch means for cabinet doors and the like. In particular, the latch means finds its greatest utility as a safety latch employed to secure, for example, the glass doors on a cabinet provided with a push latch.

BACKGROUND OF THE INVENTION

One of the concerns of parents with small children is preventing unauthorized entry by a small child into a cabinet, the contents of which may be harmful to a child or, alternatively, may be damaged by a child. As an example, a popular cabinet found in many households today is a stereo cabinet with glass panel door or doors which are provided with a push latch, and are easily opened and closed. The stereo components are in plain view through the glass, and when the stereo is in use there are usually many colorful lights which blink on and off. A small child would be especially attracted to such a display and no doubt try to gain entry to the cabinet. Because it takes only a small push on the door to unlatch a push latch, a child could easily operate the latch and open the door. Parents wishing to prevent a child from gaining entry and inadvertently ruining valuable and expensive stereo equipment would therefore desire to install tamper resistant latches on the door.

Most of the tamper resistant latches available on the market today are designed for use with cabinets having wooden or metal doors. There are virtually no latches designed for use with cabinets having glass panel doors or for cabinets employing doors latched with a push latch.

The present invention provides a tamper resistant latch particularly well-suited for use in conjunction with glass panel doors which employ a push latch. However, the invention is by no means limited to this use. The latch means is attractive and inexpensive to manufacture, and it is easy to install. In addition, although the latch of the present invention may be conveniently and quickly operated by an adult, the latch means is difficult, if not impossible, for a small child to operate.

SUMMARY OF THE INVENTION

The present invention is a tamper resistant latch for preventing unauthorized access to an enclosure, and in particular, to a cabinet having glass panel doors which are secured with a push latch. The tamper resistant latch comprises two parts, a movable member having a latch arm extending therefrom, and a keeper plate having latch arm receiving means including a latch retainer. Attached to the end of the latch arm is means for releasably engaging the latch retainer when the latch arm is fully received in the latch arm receiving means.

In use, the keeper plate is mounted inside of an enclosure, on a surface located behind the enclosure door to be secured. The movable member is movably attached to an edge of the door, such as a glass panel door, by fitting the movable member over the door edge such that when the door is closed, the latch arm extends into the interior of the enclosure and toward the keeper plate. The latch arm and the movable member are capable of lateral sliding movement together along the edge of the door. To secure the door in its closed position, the movable member is moved laterally along the door edge until the latch arm engages the latch arm receiving means, and the means at the end of the latch arm releasably engages the latch retainer. In this position, the tamper resistant latch is fully engaged and the door is secured.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 7 is a front elevational view of a cabinet on which a second embodiment of the latch has been installed.

FIG. 8 is a cross-sectional view taken along lines 8—8 of FIG. 7 showing the latch of the second embodiment in the engaged position.

FIG. 9 is a cut-away view of the top of a cabinet showing placement of the latch of the second embodiment.

FIG. 10 is a cross-sectional view taken along lines 10—10 of FIG. 9.

FIG. 11 is a perspective view of one part of the latch of the second embodiment.

FIG. 12 is a perspective view of a third embodiment of the present invention.

FIG. 13 is a cross-sectional view taken along lines 13—13 of FIG. 12 showing the latch of the third embodiment in the engaged position.

DESCRIPTION OF THE INVENTION

Figure 1:
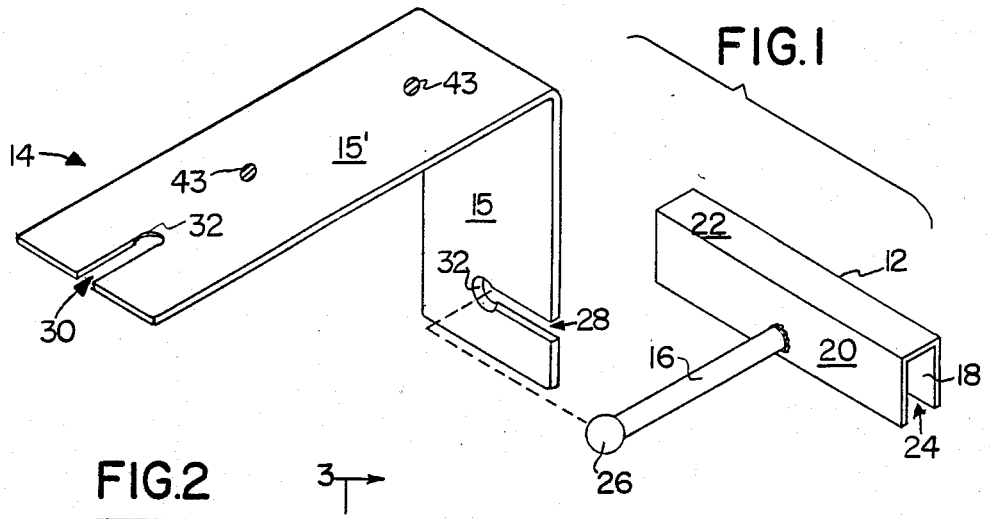
FIG. 1 is an isometric view of a tamper resistant latch according to the present invention.

Referring now to the drawings wherein like numerals indicate like elements, there is shown in FIG. 1 a tamper resistant latch 10 according to the invention. Latch 10 comprises two parts, a movable member 12 and a keeper plate 14.

Member 12 has a latch arm 16 which extends therefrom. In the preferred embodiment member 12 is U-shaped and has two side surfaces 18 and 20 connected together by perpendicular surface 22. Together, surfaces 18, 20, and 22 define a U-shaped channel 24. Channel 24 may be any shape, e.g. rectangular, as appropriate to fit the edge of a door to be secured. Latch arm 16 projects outwardly from member 12, for example at a perpendicular angle from surface 20. Arm 16 may be integrally formed with member 12 or may be a separate piece affixed to member 12 in any appropriate manner, for example, by welding or gluing. Located on the free end of arm 16, that is, the end which is not attached to member 12, is a means 26 for releasably engaging a latch retainer located in plate 14 and described below. Means 26 is preferably, but not necessarily, a sphere, and has a diameter larger than the largest transverse dimension of arm 16.

Plate 14 is shown having the shape of a rectangle. However, specific geometric shape is not crucial to the invention. In the present embodiment, plate 14 is bent at a right angle creating two plate sections 15 and 15'. Integrally formed in plate 14 are latch arm receiving means. In the preferred embodiment the latch arm receiving means are in the form of slots 28, 30. However, any form designed to receive latch arm 16 may be used. One slot is located in each of plate sections 15 and 15'. For example, slot 28 is located in section 15 and slot 30 is located in section 15'. Slots 28, 30 are oriented 90° apart. This structure permits the keeper plate to be mounted on either a horizontal cabinet member, as shown in the drawings, or on a vertical cabinet member. The width of each slot 28, 30 is slightly greater than the largest transverse dimension of arm 16, to allow for receiving arm 16 into either slot 28 or 30. Each slot 28, 30 terminates at one end in a latch retainer. In the preferred embodiment the latch retainer is in the form of a circular countersink 32 having a suitable diameter for receiving means 26 described above as being a sphere.

Figure 2:
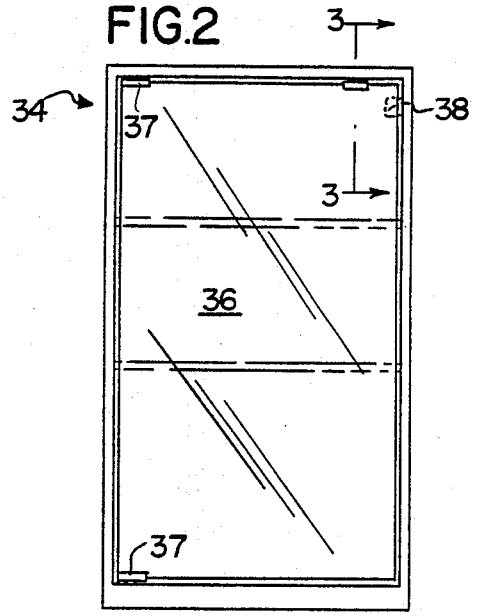
FIG. 2 is a front elevational view of a cabinet on which the latch has been installed.
Figure 3:
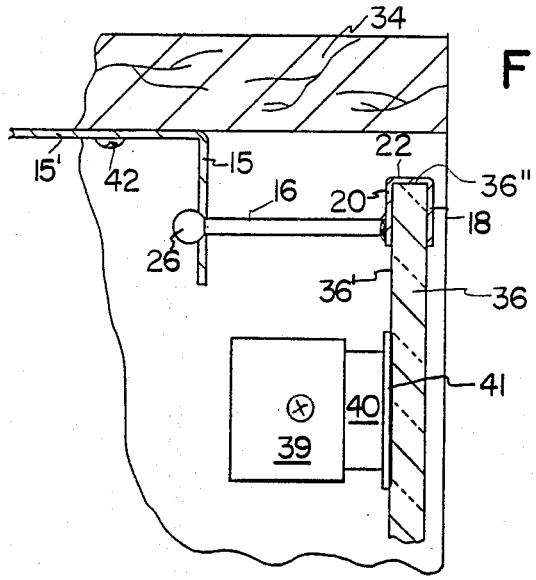
FIG. 3 is a cross-sectional view taken along lines 3—3 of FIG. 2 showing the latch in the engaged position.

Latch 10 is designed to be used in an enclosure such as cabinet 34 shown in FIGS. 2 and 3. Cabinet 34 is, for example, a typical cabinet designed to house a stereo system. Cabinet 34 has a glass panel door 36 which is attached at one end by hinges 37 and cooperates with a push latch 38 on the other end to open and close door 36. Although the push latch is known in the art and is not a part of this invention, a brief explanation of its construction and operation will aid in understanding the present invention. Push latch 38 comprises a latch housing 39, a magnetic latch 40 partially located inside of, and protruding slightly out of, housing 9, and a strike plate 41. Housing 39 and magnetic latch 40 are typically mounted on an inner surface of cabinet 34. Strike plate 41 is mounted on the inside surface 36, of door 36 such that when door 36 is in the closed position strike plate 41 contacts and cooperates with magnetic latch 40 to hold the door closed. Magnetic latch 40 is capable of motion into and out of housing 39, and of assuming three positions. Position I (not shown) is the fully extended position whereby magnetic latch 40 protrudes out of housing 39 to the fullest extent possible. In position I push latch 38 is unlatched. Position II (seen in FIG. 3 and in phantom in FIG. 6) is the closed position, that is, the position in which push latch 38 is latched. Position III (seen in FIG. 4 and in FIG. 6) is the extreme inward position. In position III, magnetic latch 40 is located almost completely inside housing 39.

To operate the push latch, door 36 is swung inward on hinges 37 such that strike plate 41 contacts magnetic latch 40. Magnetic latch 40 is in position I. A force is applied to door 36, moving door 36 inwardly and pushing magnetic latch 40 through position II and into position III. While in position III, magnetic latch 40 engages internal means inside housing 39, not a part of this invention. The internal means are designed to releasably hold magnetic latch 40 in position II. Once the internal means are engaged the inward force applied to door 36 is removed. Magnetic latch 40 returns to and is held in the closed position II and door 36 comes to rest in its latched position. In order to unlatch door 36, an inward force is again applied to the door causing magnetic latch 40 to move from the closed position II to the extreme inward position III where magnetic latch 40 disengages from the internal means which held magnetic latch 40 in position II. The inward force is then removed and latch 40 springs outward, under the force of an internal spring means (not shown), past the closed position II and into the fully extended position III, at the same time causing door 36 to swing open.

To use the present invention with a door and magnetic latch as described above, latch 10 is installed in cabinet 34 as described below. Plate 14 is mounted on an inside surface of cabinet 34 in any appropriate manner, for example, with screws 42. One section of plate 14, for example section 15', has bores 43 for receiving screws 42, thus facilitating the attachment of plate 14. Plate 14 is mounted such that it lies behind door 36, see FIGS. 3 and 4. Member 12 is fitted over, and is slidable along the length of, an edge 36" of door 36 such that member 12 is capable of contacting plate 14.

Figure 6:
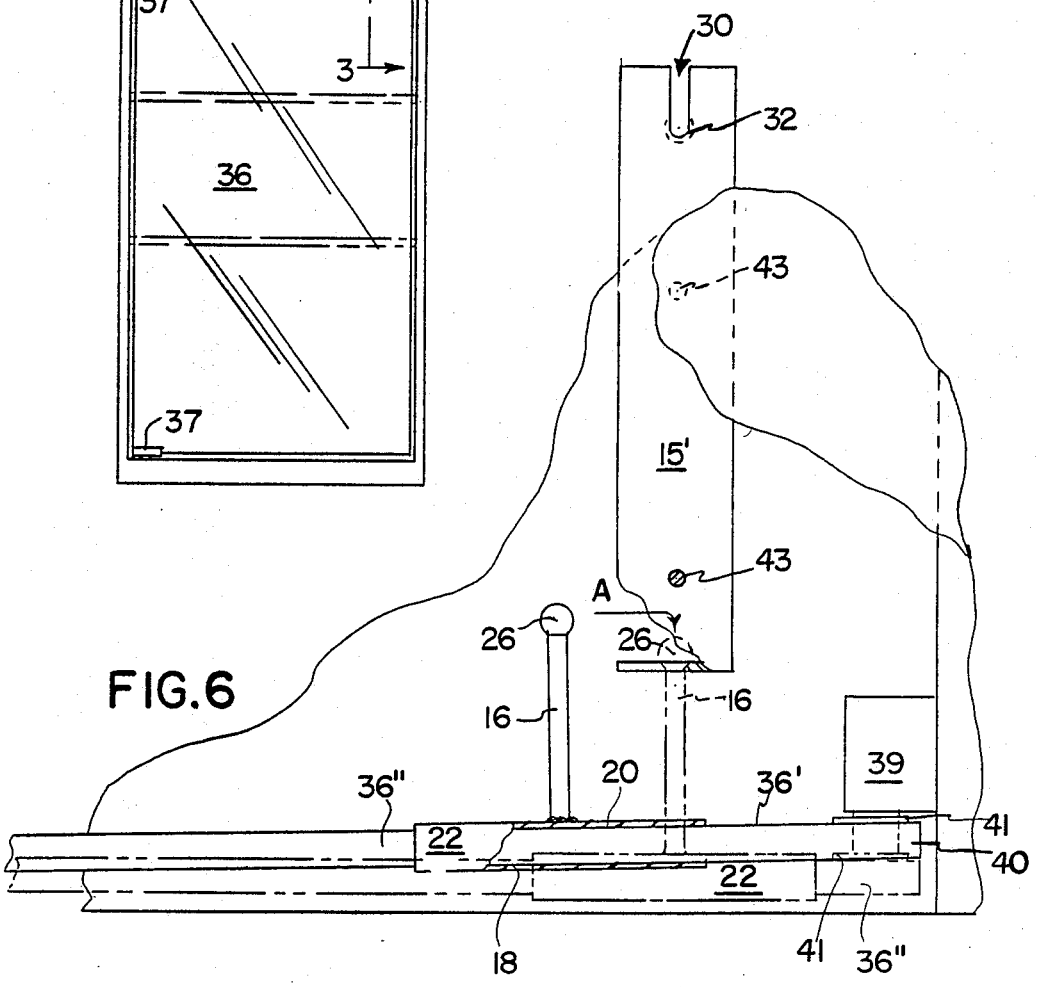
FIG. 6 is a cross-sectional view of the latch in FIG. 5, showing engagement of the latch.
Figure 4:
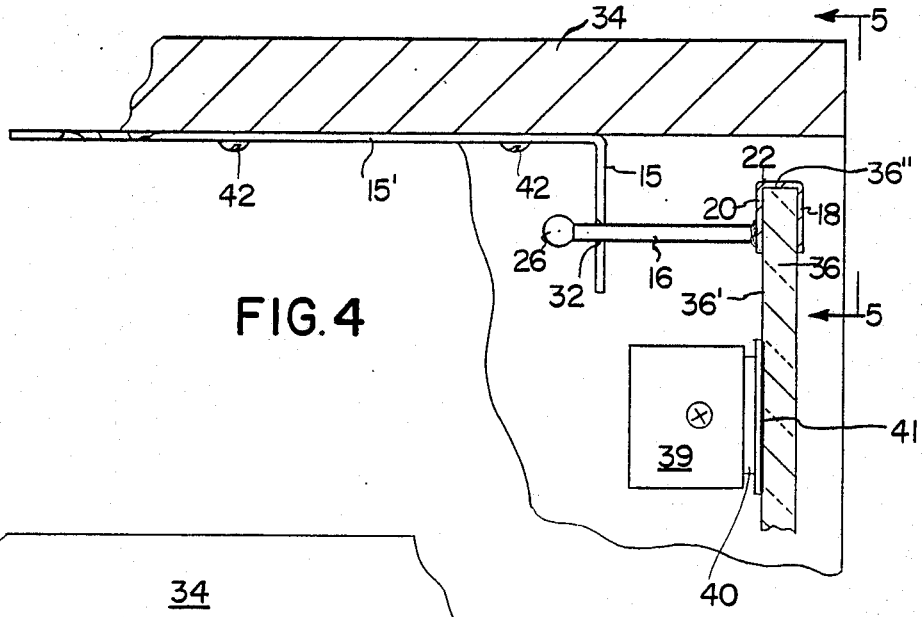
FIG. 4 is a cross-sectional view similar to FIG. 3 showing the latch in the process of being disengaged.
Figure 5:
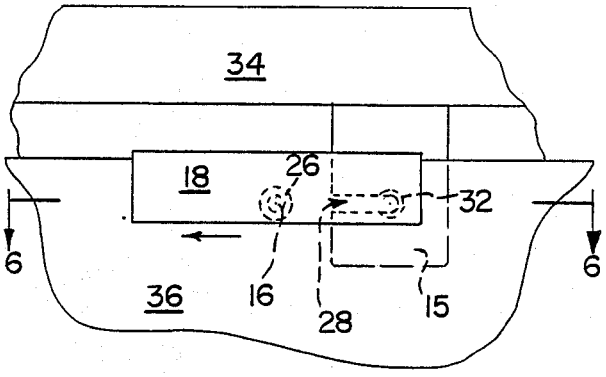
FIG. 5 is a cross-sectional view taken along lines 5—5 of FIG. 4.

To operate latch 10, a force is applied to door 36 as described above, moving door 36 inwardly and moving magnetic latch 40 into position III (see FIG. 4 and FIG. 6). While magnetic latch 40 is in position III, member 12 is moved laterally along edge 36" toward plate 14 until arm 16 engages slot 28 as shown by directional arrow A in FIG. 6. Member 12 is moved in the direction of arrow A until further movement in that direction is impeded by the end of countersink 32. Once arm 16 engages countersink 32, the force on door 36 is released. As described above, magnetic latch 40, engaged by internal means in housing 39, comes to rest in position II (see FIG. 3), causing door 36 to move into its latched position. As shown in phantom in FIG. 6, when door 36 moves into its latched position, it pulls means 26 into countersink 32. Further lateral movement of member 12 along edge 36" is very difficult with means 26 seated in countersink 32. With latch 10 thus engaged, any attempts to open door 36 using only the push latch 38 are frustrated. Latch arm 16 cannot be pulled away from the keeper plate 14 until means 26 is disengaged from countersink 32.

To release latch 10 and open door 36, a force is applied to door 36 moving door 36 inward, and moving latch 40 into position III. While door 36 is in this position, means 26 clears countersink 32 (see FIG. 4). Member 12 is then free to move laterally along edge 36" away from keeper plate 14, thus disengaging arm 16 from slot 28. Once member 12 is free of plate 14 the force is released and latch 40, released by the internal means in housing 39, moves into position I, freeing door 36 to swing open.

In a second embodiment, a latch 10' is installed in a cabinet 44. Cabinet 44 has double doors 46 and 46' (see FIG. 7) which are mounted by hinges 48 and 48', respectively. Each door 46, 46' cooperates with a push latch 50, 50', respectively to open and close the doors. Push latches 50, 50' operate in the same fashion as push latch 38 by moving through the three positions. Position I (seen in FIG. 9) is the fully extended (open) position, position II is the closed position, and position III is the extreme inward position.

Latch 10' comprises two parts, a movable member 52 (see FIG. 9) and a keeper plate 54. In the preferred embodiment, member 52 is identical to member 12 described above, and has a latch arm 56 extending therefrom at a perpendicular angle. Arm 56 may be integrally formed with member 52 in any appropriate manner, for example, by welding or gluing. Attached to the free end of latch arm 56 is means 58 for releasably engaging a latch retainer located in plate 54 and described below. Means 58 is preferably, but not necessarily, a sphere and has a diameter larger than the largest transverse dimension of arm 56.

In the preferred embodiment, seen in FIG. 11, plate 54 is U-shaped and comprises two parallel surfaces, 66 and 68, joined together by a front surface 70. However, specific shape is not crucial to the invention. Integrally formed in plate 54 is latch arm receiving means. In the preferred embodiment, the latch arm receiving means is in the form of a bore 72 located in one of the parallel surfaces, for example, in surface 66, and a slot 74 located in surface 70. However, any form designed to receive latch arm 56 may be used.

The diameter of bore 72 is large enough to permit means 58 to pass through it, and the width of slot 74 is slightly greater than the largest transverse dimension of arm 56, to allow receiving arm 56. Slot 74 terminates at one end in a latch retainer. In the preferred embodiment, the latch retainer is in the form of a circular countersink 76 having a suitable diameter for receiving means 58 described above as being a sphere.

In use, latch 10' is installed in cabinet 44 as described below. Plate 54 is mounted on an inside surface 45 of cabinet in any appropriate manner, for example with screws 64. To facilitate the mounting, plate 54 is provided with flanges 60 and 60' which are perpendicular to, and project laterally outward from, surfaces 66 and 68. Bores 62, 62' are located in flanges 60, 60' respectively. Plate 54 is mounted approximately in the center of surface 45 behind the spot where doors 46 and 46' come together. Flanges 60, 60' are positioned flush against surface 45 and screws 64 engage bores 62, 62' to secure plate 54 in place.

To operate latch 10', member 52 is fitted over, and is slidable along, a top edge of one door, for example, edge 47 of door 46 (see FIG. 9). A force is applied to both doors 46 and 46' moving them toward the interior of cabinet 44 a short distance, and moving push latches 50 and 50' into position III. While in this position, member 52 is moved laterally along edge 47 toward plate 54 until means 58 engages bore 72 and latch arm 56 engages slot 74. Member 52 is moved laterally in slot 72 and engages edge 47' of door 46', until further movement of member 52 is impeded by the end of countersink 76. The force on doors 46, 46' is then released and magnetic latches 50, 50' come to rest in position II, as seen in FIG. 10, causing doors 46, 46' to move into their latched position. Means 58 is also pulled by doors 46, 46' into engagement with countersink 76, making further lateral movement of member 52 very difficult. With latch 10' thus engaged, any attempt to open doors 46, 46' using only the push latches 50, 50' is frustrated.

To release latch 10', a force is applied to doors 46, 46' moving doors 46, 46' inwardly and moving latches 50, 50' to position III. In this position, means 58 clears countersink 76. Member 52 is then free to move laterally along edges 47, 47' and away from plate 54, thus disengaging arm 56 from slot 74. Once arm 56 is disengaged the force is released allowing latches 50, 50' to spring open into position I, freeing doors 46, 46' to swing open.

A third embodiment of the invention is shown in FIGS. 12 and 13. Latch 10'' comprises two parts, a movable member 78 and a keeper plate 80. Keeper plate 80 is identical to plate 14 and has two surfaces 81, 81'. Integrally formed in plate 80 is latch arm receiving means in the form of a slot 82. Slot 82 can be located in either surface 81, 81', and is shown in surface 81. As with slots 28, 30 of plate 14, slot 82 terminates at one end in a latch retainer preferably in the form of a countersink 84.

Member 78 comprises a latch arm 86 extending therefrom. Attached to the end of arm 86 is a head 88. Slidably movable along arm 86 is means 90 for releasably engaging countersink 84. Means 90 has a bore 92 therethrough which receives arm 88. A spring 94 is provided around arm 86 between head 88 and means 90. Spring 94 biases means 90 towards countersink 84 when member 78 engages keeper plate 80 as described below.

In use, plate 80 is secured to an inside surface 96 of a cabinet 98, as described in the previous embodiments, for example, by a screw 100, as seen in FIG. 13. Member 78 is fitted over an edge 102 of a door 104, on cabinet 98. Member 78 is positioned such that arm 88 extends into the interior of the cabinet when door 104 is closed. As described in the two previous embodiments, a force is applied to door 104 moving it inward and operating its push latch, and member 78 is moved laterally along edge 102 toward keeper plate 80 until latch arm 86 engages slot 82. When the force is released and the door 104 is in the closed position, means 90 is biased by spring 94 into countersink 84 so that it fits securely. In this position it is impossible to open door 104 without disengaging means 90 from countersink 84. However, it is readily possible to disengage the means 90 from the countersink 84 by sliding member 78 away from keeper 80 when door 104 is pushed inwardly. The means 90 will ride up the inclined surface of countersink 84 compressing spring 94 and allowing means 90 to disengage from the countersink as member 78 is moved away from keeper 80.

The present invention may be embodied in other specific forms without departing from the spirit or essential attributes thereof and, accordingly, reference should be made to the appended claims, rather than to the foregoing specifications, as indicating the scope of the invention.

I claim:

1. A tamper resistant latch comprising:

(a) a reciprocally movable member having a latch arm extending therefrom in a direction substantially perpendicular to the direction of movement of said member, the latch arm having a shank terminating in a generally spherical member of a diameter larger than the largest transverse dimension of the shank; and (b) a keeper plate being disposed between the movable member and the generally spherical member at the end of the shank and having at least one slot therein with an open end for receiving the shank of the latch arm, the slot terminating at the non-open end in an at least partially recessed latch retainer;

(c) the generally spherical member at the end of the latch arm being positively seated in the latch retainer when the latch arm shank is fully received in the slot so as to prevent movement of the movable member and whereby relative movement of the movable member and the keeper plate toward one another is required to unseat the generally spherical member from the latch retainer so as to permit movement of the movable member.

2. The apparatus of claim 1 wherein the movable member further comprises a channel adapted and arranged to receive an edge of a door.

3. The apparatus of claim 1 wherein the width of said at least one slot is slightly larger than the largest transverse dimension of the shank of the latch arm.

4. The apparatus of claim 1 wherein the keeper plate comprises two integral perpendicular surfaces, each surface having a slot therein.

5. The apparatus of claim 1 wherein the keeper plate comprises two parallel surfaces separated apart at a fixed distance and joined together by a third perpendicular surface.

6. The apparatus of claim 3 wherein the latch retainer comprises a countersink located at one end of said at least one slot.

7. A tamper resistant latch adapted to secure at least one hinged door of an enclosure in a closed position comprising:

(a) a reciprocally movable member having a channel adapted to receive one edge of said at least one door, said movable member having a latch arm extending therefrom in a direction substantially perpendicular to the direction of movement of said member, the latch arm having a shank terminating in a generally spherical member of a diameter larger than the largest transverse dimension of the shank; and (b) a keeper plate attached to an inside surface of the enclosure comprising at least one slot therein with an open end for receiving the shank of the latch arm, the width of the slot being slightly greater than the largest transverse dimension of the latch arm, said slot terminating at the non-open end in a countersink, the keeper plate being disposed between the movable member and the generally spherical member at the end of the shank;

(c) the generally spherical member attached at the end of the latch arm being positively seated in the countersink when the latch arm shank is fully received in the slot so as to prevent movement of the movable member and whereby movement of the door inwardly toward the interior of the enclosure is required to unseat the generally spherical member from the countersink so as to permit movement of the movable member.

8. The apparatus of claim 6 wherein the keeper plate comprises two integral perpendicular surfaces, each surface having a slot therein, and means for attaching said keeper plate to an inside surface of the enclosure.

9. The apparatus of claim 6 wherein the keeper plate comprises two parallel surfaces separated by a fixed distance and joined together by a third perpendicular surface and means for attaching said keeper plate to an inside surface of the enclosure.

10. The apparatus of claim 6 wherein the spherical member is adapted to receive and move along the latch arm, said latch arm having stop means for preventing the spherical member from being separated from the latch arm.

11. The apparatus of claim 8 wherein the spherical member is biased toward the movable member by a spring means.

12. The apparatus of claim 11, wherein the spring means is coiled around the latch arm and is located between the spherical member and the stop means.

13. A tamper resistant latch adapted to secure in a closed position at least one door of an enclosure utilizing a push latch, said tamper resistant latch comprising:

(a) a movable member having a channel adapted to receive one edge of the at least one door, said movable member having a latch arm extending therefrom;

(b) a keeper plate attached to an inside surface of the enclosure comprising at least one slot, the width of which is slightly greater than the largest transverse dimension of the latch arm, said slot terminating at one end in a countersink; and (c) a spherical member adapted to receive and move along the latch arm, said latch arm having stop means to prevent the spherical member from being separated from the latch arm, said spherical member being of a diameter larger than the largest transverse dimension of the latch arm and adapted to releasably engage the countersink when the latch arm is fully received, said spherical member being biased toward the movable member by a spring means.

14. The apparatus of claim 13 wherein the spring means is coiled around the latch arm and is located between the spherical member and the stop means.

15. The apparatus of claim 13 wherein the keeper plate comprises two perpendicular surfaces, each surface having a slot therein and means for attaching said keeper plate to an inside surface of the enclosure.

16. The apparatus of claim 13 wherein the keeper plate comprises two parallel surfaces separated apart at a fixed distance and joined together by a third perpendicular surface and means for attaching said keeper plate to an inside surface of the enclosure.

17. A tamper resistant latch comprising:

(a) a movable member having a latch arm extending therefrom;

(b) a keeper plate having latch arm receiving means including a latch retainer, the keeper plate comprising two integral perpendicular surfaces, each surface having a latch arm receiving means therein in the form of a slot, the width of the slot being slightly larger than the largest transverse dimension of the latch arm, the keeper plate further comprising means for attaching said keeper plate to an inside surface of an enclosure, the latch retainer comprising a countersink located at one end of each slot; and (c) means at the end of the latch arm for releasably engaging the latch retainer when the latch arm is fully received in the latch arm receiving means.

18. A tamper resistant latch according to claim 17, wherein the keeper plate is adapted to be mounted on either a vertical or horizontal inside surface of the enclosure.

* * * * *